US005094566A

United States Patent [19]

Parks

[11] Patent Number: 5,094,566

[45] Date of Patent: Mar. 10, 1992

[54] PERISTALTIC FLUIDIZATION OF NON-COHESIVE SUBSOILS

[76] Inventor: James M. Parks, 3509 Merrick Ct., #210, Lexington, Ky. 40502

[21] Appl. No.: 565,283

[22] Filed: Aug. 1, 1990

[51] Int. Cl.[5] ..... E02B 3/02

[52] U.S. Cl. ..... 405/74; 405/15; 405/21

[58] Field of Search ..... 405/74, 21, 52, 43, 405/45, 25, 61

[56] References Cited

U.S. PATENT DOCUMENTS

| | | | |
|---|---|---|---|
| 3,013,395 | 12/1961 | Gaylord | 405/74 |
| 3,461,674 | 8/1969 | Katzer et al. | 405/74 |
| 3,638,432 | 2/1972 | Schoonmaker | 405/74 |
| 4,074,535 | 2/1978 | Schoonmaker | 405/74 |
| 4,147,450 | 4/1979 | Schoonmaker | 405/74 |
| 4,645,377 | 2/1987 | Vesterby | 405/21 X |
| 4,898,495 | 2/1990 | Lin | 405/73 |
| 5,022,784 | 6/1991 | DeVries et al. | 405/74 X |

*Primary Examiner*—Dennis L. Taylor
*Attorney, Agent, or Firm*—Charles A. McClure

[57] ABSTRACT

Segmented fluidization of underwater subsoils in a manner resembling peristalsis. An array of underwater locations is selected, and water is injected into the subsoil, preferably in a pattern of sequence and duration to generate lateral flow of fluidized subsoil. Apparatus for practicing such method includes a water supply pipe, multiple water-jetting branch tubes interconnected to respective segments of the supply pipe, each such branch tube being individually valved at its junction thereto. Valve-control apparatus is provided to open and close the respective valves at given times and for given durations, as by pre-programming, or optionally controlled according to resulting flow and/or pressure monitored by nearby sensors.

16 Claims, 3 Drawing Sheets

PERISTALTIC FLUIDIZATION OF NON-COHESIVE SUBSOILS

TECHNICAL FIELD

This invention relates to fluidization of non-cohesive subsoils and concerns pulsed segmented or "peristaltic" fluidization thereof.

BACKGROUND OF THE INVENTION

Injection of water into non-cohesive subsoils fluidizes them, rendering them readily pumpable. Such subsoil overlain by a liquid medium becomes transportable by local currents upon being fluidized.

Navigable channel maintenance traditionally is attempted by dredging, repeated whenever nature fills in an existing or former channel—usually more often than anticipated. Dredging costs are so high the first time around that the necessity of periodic redredging is either not considered, or if considered is deemed an unacceptable aggravation of expense. Accordingly, in many instances no effective action is taken. Dredging itself is often so disruptive to the underwater landscape as to induce deleterious changes in currents, together with unwanted transport and redeposition of sandy subsoils.

Fluidization as a supplement or preferably as an alternative to dredging is becoming recognized, and also publicized, as by Bruun in "Maintaining Tidal Inlet Channels by Fluidization" *J. Waterway, etc. Engineering*, ASCE, 110 (ww4) 117-120; Bruun and Adams in "Stability of Tidal Inlets: Use of Hydraulic Pressure for Channel and Bypassing Stability" *J. Coastal Research* 4 (1988) 687-701; and by the present inventor with others, especially Weisman and Collins, as in "Fluidization as Applied to Sediment Transport (FAST) as an Alternative to Maintenance Dredging of Navigation Channels in Tidal Inlets" *Wastes in the Ocean vol II:* Dredged Material Disposal in the Ocean, Kester et al. (eds.) Wiley (1983).

Accordingly, shoals in an otherwise navigable channel or similar waterway can be relocated downstream upon being fluidized. Optionally, if natural drift at a shoal location is not favorable, but a not-too-distant region has favorable prevailing currents, the fluidized subsoil can be collected, be pumped to, and be released at the latter location for natural redistribution. Another option or related variation is suggested by Lin in U.S. Pat. No. 4,898,495. As the physical characteristics and behavior of non-cohesive subsoils become better understood, fluidization doubtless will be recognized as the procedure of choice, both technically and economically, to solve such environmental problems as shoaling of navigable channels.

Underwater collection of fluidized subsoil is essential to the more active redistribution according to the second and third of the foregoing options. My present invention is directed mainly toward modifying fluidization of non-cohesive subsoils so as to facilitate their redistribution, and especially to their underwater collection.

SUMMARY OF THE INVENTION

A primary object of the present invention is to enhance the use and the benefits of fluidization for underwater subsoil relocation.

Another object of this invention is to assure lateral transport of underwater non-cohesive subsoil via intermittent fluidization.

A further object of the invention is to monitor the underwater flow of fluidized non-cohesive subsoil.

Yet another object is to provide improved underwater collection of fluidized non-cohesive subsoil.

A still further object is to accomplish such collection and redistribution of fluidized subsoil economically and effectively.

In general, the objects of the present invention are attained by segmentation of fluidization of underwater subsoils and patterned pulsing of the segments in a manner resembling peristalsis. More particularly, this invention involves selecting locations spaced in an array, injecting water into the subsoil throughout the array, preferably in a pattern of sequence and duration to generate lateral flow overhead, thereby transporting fluidized subsoil laterally.

Apparatus for practicing such method includes a supply pipe, into which water for fluidization is pumped, multiple foraminous branch pipes interconnected to respective successive segments of the supply pipe, each such branch pipe being individually valved at its junction thereto. Valve-control apparatus is provided to open and close the respective valves at given times and for given durations, as in accordance with pre-programming, optionally controlled according to resulting flow and/or pressure monitored by nearby sensors.

Other object of the present invention, together with means and methods for attaining the various objects, will be apparent from the following description and accompanying diagrams of preferred embodiments, which are presented by way of example rather than limitation.

DESCRIPTION OF THE INVENTION

Figure 1:
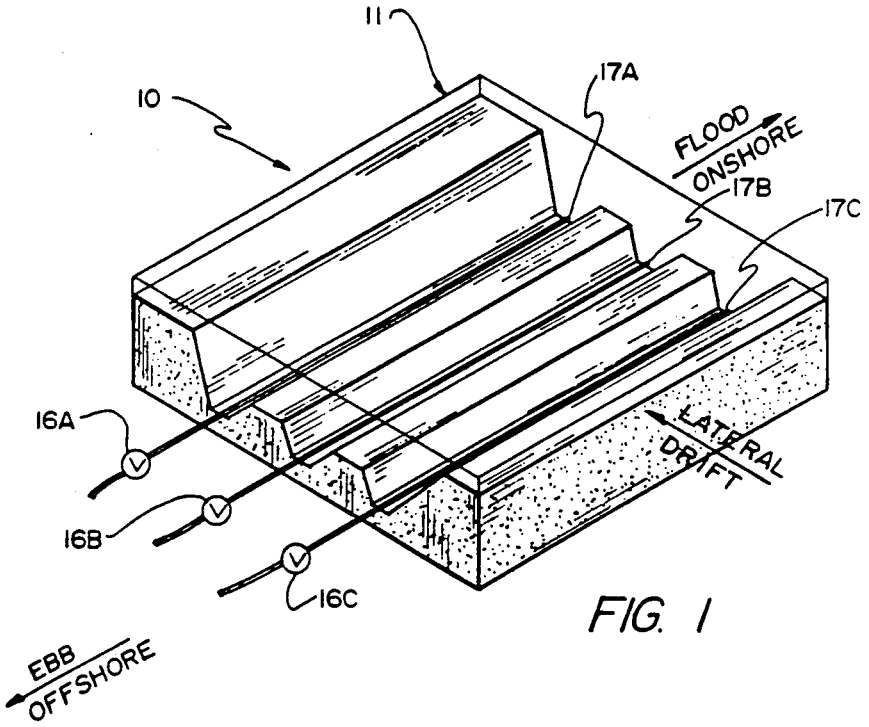
FIG. 1 is a schematic perspective illustration of an embodiment of fluidization of non-cohesive subsoil, as in channel maintenance, according to the present invention.

FIGS. 1 shows schematically, in sectional perspective, a first embodiment 10 of this invention as parallelepipedal block 11 of a channeled section of non-cohesive subsoil 15 having therein several side-by-side mini-channels 17A, 17B, 17C. Three parallel fluidization pipes 16A, 16B, 16C—each with a valve V therein—extend along the bottoms of the respective mini-channels from the OFFSHORE or EBB area (arrow to lower left) upgrade into the ONSHORE or FLOOD direction (arrow to upper right). An arrow to the upper left indicates LATERAL DRIFT or natural alongshore current flow direction.

The contouring illustrated in FIG. 1 conforms to fluidization results. As expected, the elevation of subsoil between adjacent mini-channels is less than at opposite sides of the entire channel. The rather angular stylization of the drawing is for simplicity of the showing, whereas in nature edges and surfaces of non-cohesive subsoils normally are rounded to a greater or lesser degree and/or extent. Connections to the pipes are omitted likewise as being readily improvised by persons ordinarily skilled in the art.

Figure 2:
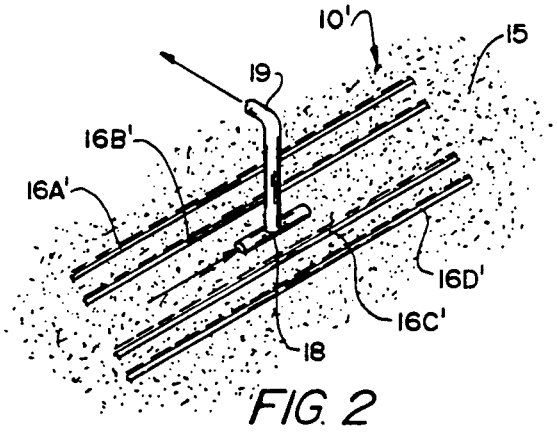
FIG. 2 is a schematic plan view of another embodiment of fluidization, with pump-assisted removal, according to this invention.

FIG. 2 is a schematic perspective of fluidization embodiment 10' of this invention viewed from above. Instead of the three pipes of the preceding view, two pairs of parallel pipes 16A' & 16B' plus 16C' & 16D' are spaced laterally apart, in non-cohesive subsoil 15 (stippled). Upright exhaust pipe 19 rises above the plane of the pipes from inlet tee 18 (with inlet arrows)—where the center of the middle pipe was in FIG. 1—and is broken off in a horizontal drift direction at the top (with arrow). An eductor pump for producing exhaust flow in pipe 19 is not shown here but will be understood.

Figure 3:
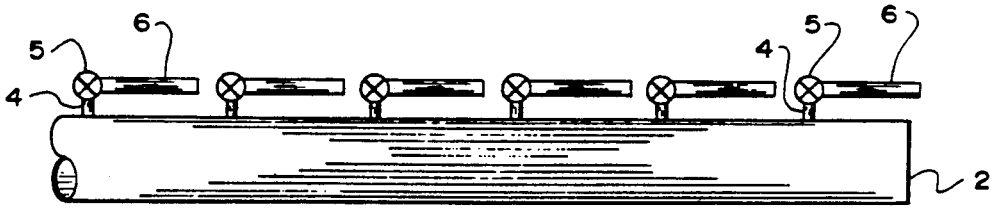
FIG. 3 is a plan view of an uninstalled length of segmented fluidization pipe or manifold with multiple foraminous branch lines, according to this invention.

FIG. 3 shows in elevation (in a shipping orientation) supply fluidization pipe or manifold assembly 16 featuring supply pipe 2 and spaced close above it a parallel row of relatively shorter foraminous water-jetting tubes 6, each offset from the larger pipe by intervening tube 4 and valve 5 at the junction between 4 and 6. The pipe may be thought of as segmented by the intersecting tubes 4 with their associated jetting means. It will be understood that the detail shown here did not appear in preceding views because of the considerable difference in scale.

Figure 4:
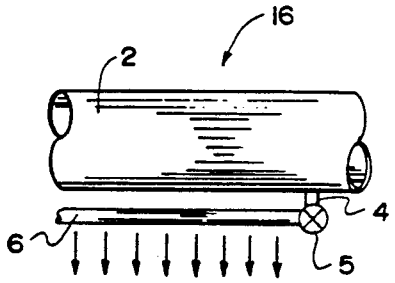
FIG. 4 is a fragmentary side elevation of a single segment of the fluidization pipe shown in FIG. 3, oriented with its foraminous branch line in use position underneath the pipe.

FIG. 4 shows in elevation (in working orientation) one segment of the assembly shown to a greater extent in the last preceding view with downwardly directed arrows indicating the jetting of water from the foramina in the tubes into the subsoil (not separately shown).

Figure 5A:
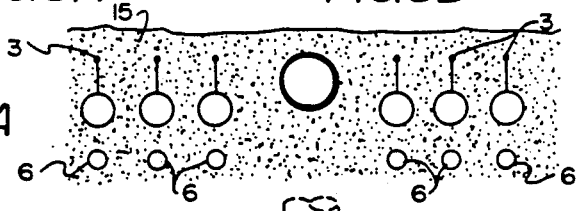
FIG. 5A is a schematic end sectional elevation of yet another embodiment of this invention, shown buried and before fluidization.

FIG. 5A shows schematically fluidization embodiment 10" of this invention, which differs from the embodiment of FIG. 2 in having the supply pipes and their attached water-jetting tubes buried in sandy subsoil 15. This view also differs from that previous view by substitution of trios of pipes (instead of the pairs of pipes there) flanking the centerline of the channel. Optional (broken lines) intake tee with exhaust riser 19 is shown centered here. Supply pipes 16A", 16B", 16C" are at the left, and 16D", 16E", 16E" at the right. Underlying and interconnected thereto (interconnection not shown) are corresponding water-jetting tubes 6. Supported above respective supply pipes on flexible stalks 1 are sensors 3 responsive to water flow and/or pressure (electrical connections to sensors not shown).

Figure 5B:
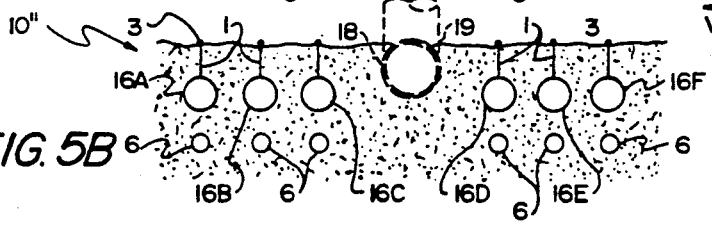
FIG. 5B is a schematic view similar to FIG. 5 but shown after performance of fluidization.

FIG. 5B shows fluidization embodiment 10" similarly to FIG. 5A, except after (instead of before) recent fluidization and similarly to FIG. 1 in that respect. Sandy subsoil 15 has been redistributed, resulting in a well defined open channel between banks at opposite sides at about the general surface level in the last preceding view.

Figure 6:
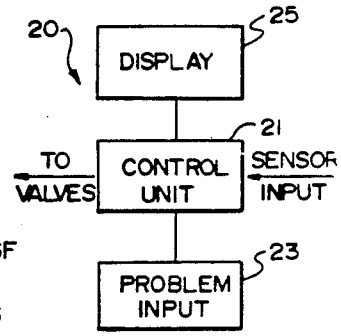
FIG. 6 is a schematic representation of a control unit for the individual valves of the foraminous branches of fluidization piping.

FIG. 6 shows control apparatus 20 for the respective valves of the water-jetting tubes of the preceding views. Features is CONTROL UNIT 21, which is provided with PROGRAM INPUT means 23 and with DISPLAY means 25. SENSOR INPUT is provided to the CONTROL UNIT as is indicated by the leftward arrow at the right, and control signals go from it TO VALVES as is indicated by the leftward arrow at the left.

A principal function of the program input is to time the opening and closing of the fluidization valves so as to produce the desired lateral transport of the non-cohesive subsoil. Such programming may be done in advance or may be done in real time by a human operator, as will be readily understood. Valve control is guided by a theoretical understanding of the physical conditions being dealt with and/or by monitoring of changes in physical conditions as they are being achieved, preferably by both such types of input. Sensed water flow and/or pressure can constitute suitable input signals.

It will be understood that the FIG. 6 CONTROL UNIT conveniently is in the form of a digital computer, including one or more central processing units (CPUs) and analog-to-digital modems to convert analog signals from the sensors to digital signals for processing. The control signals to the valves are conveniently of ON/-OFF binary type, but graduated analog signals can be output for finer control of the valves, if desired. The PROGRAM INPUT means includes a keyboard and also electrical and/or optical means for reading program disks or the like. The DISPLAY MEANS can show assumed or measured physical conditions, including the results of simulations provided by CPU(S) in the CONTROL UNIT and optionally real-time results being monitored by the underwater sensors.

The next sets of diagrams show examples of lateral transport of non-cohesive subsoil (such as sand) achievable by the "peristaltic" control of the fluidization valves according to this invention. In these views stippling indicates respective fluidized subsoil areas.

Figure 7A:
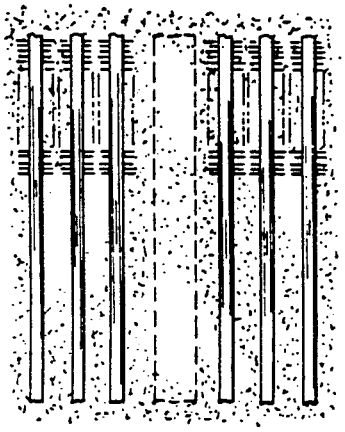
FIGS. 7A, 7B, and 7C are plan views of a working fluidization array of the invention at successive lengthwise timed intervals.
Figure 7B:
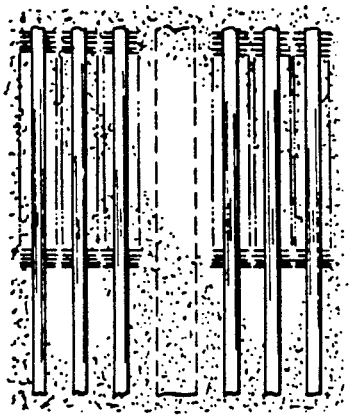
Figure 7C:
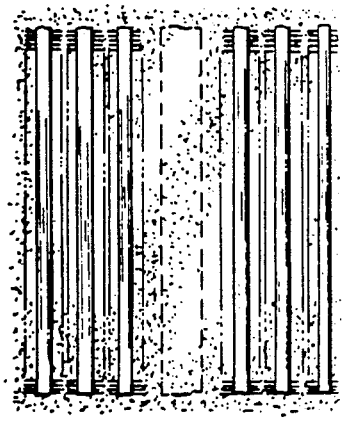

FIGS. 7A, 7B, and 7C are plan views of fluidization embodiment 10" at successive timed intervals, with the subsoil fluidized first in the top third, then in the middle third, and finally in the bottom third of the view. Though progressing lengthwise of the piping, such direction is considered to be lateral relative to the entire fluidizing array. As the pressure increases sequentially in such top-to-bottom direction in these views, water flow occurs along the resulting gradient, which is mainly in the opposite direction, similarly considered lateral relative to the array. For example, where the pipes are laid outward from the shoreline, the subsoil may be so transported to a location far enough offshore to intercept a longshore drift effective to convey it away. The central region outlined in broken lines between the trios of pipes is not required in this mode of operation but is included as useful for other operating modes, such as the one shown in the next series of views.

Figure 8A:
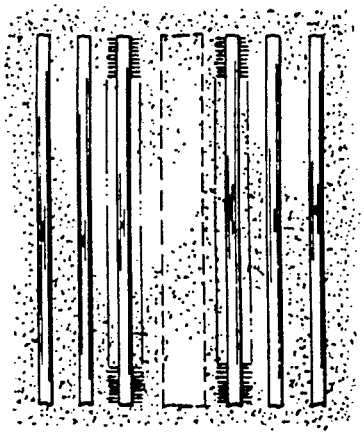
FIGS. 8A, 8B, and 8C are plan views of a working fluidization array of this invention at successive widthwise timed intervals.
Figure 8B:
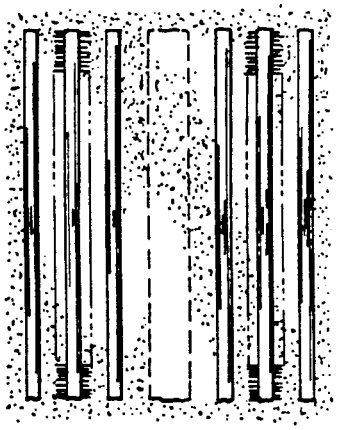
Figure 8C:
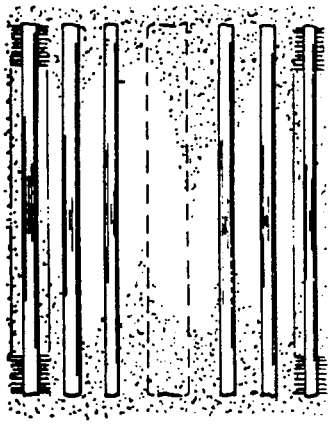

FIGS. 8A, 8B, and 8C are plan views of embodiment 10'' as in the preceding set of views except showing fluidization at successive widthwise timed intervals. In FIG. 8A the fluidization begins in the lengths nearest the broken-line showing between the pipe trios, then progresses to the next flanking pipes, and finally to the two outermost ones. This produces a double gradient from the left and right sides toward the broken-line intermediate region, transporting the fluidized subsoil thereto, from which it can be piped away i.e., educted by one or more intake tees 18 and exhaust risers 19 as suggested in FIG. 2 and FIG. 5B, for example. It will be apparent that, where only one such intake is employed, the fluidization valve sequencing preferably proceeds similarly in both horizontal dimensions, outward from the center toward the perimeter, so as to produce a counter-flow of fluidized subsoil from the outer reaches of the array toward the centralized pickup point. The pickup eduction will accentuate the gradient in that direction.

In the absence of an eductor intake along the centerline, an outward-in fluidization sequencing may be employed to transport the fluidized subsoil progressively from the centerline outward, as to produce a conventional channel configuration: low along the centerline and on both sides thereof for the desired width of the channel. In such conditions, an odd number of parallel fluidization pipes may employed, with one inserted along the centerline as in FIG. 1.

Succeeding diagrams show the clearing of a shoaled channel and also the restoration of an eroded beach according to this invention.

Figure 9:
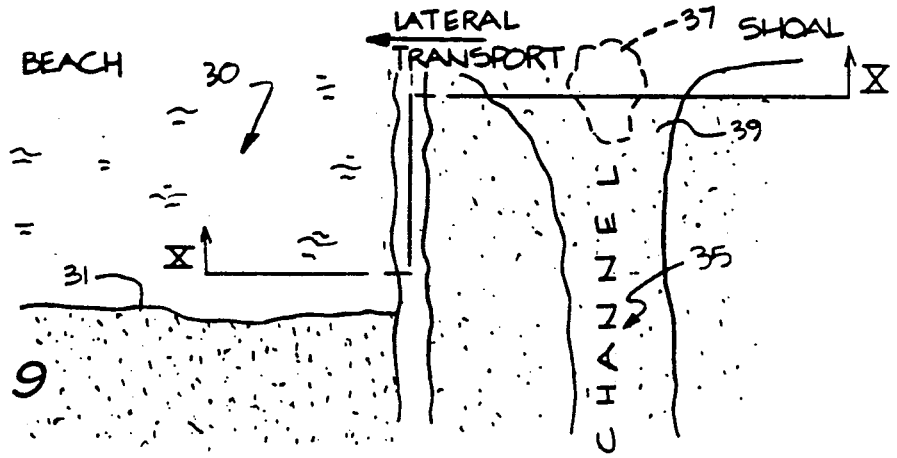
FIG. 9 is a schematic plan of an eroded beach at the left and a shoaled navigation channel at the right, spaced laterally apart.

FIG. 9 shows, schematically in plan, a "split-screen" view of BEACH 30 at the left and navigation CHANNEL 35 between banks 39 at the right. ERODED SHORELINE 31 marks the present extent of the beach. The channel is blocked by SHOAL 37 (broken lines because submerged) at mouth 39 thereof. An offshore arrow indicates LATERAL DRIFT (right to left). An intermediate part of the view is broken away to suggest that its side portions are spaced laterally apart by an indefinite distance. Section line X-X superimposed on this view runs rightward substantially parallel to the shoreline just onshore, then doglegs offshore and rightward to cross the shoal similarly.

Figure 10:
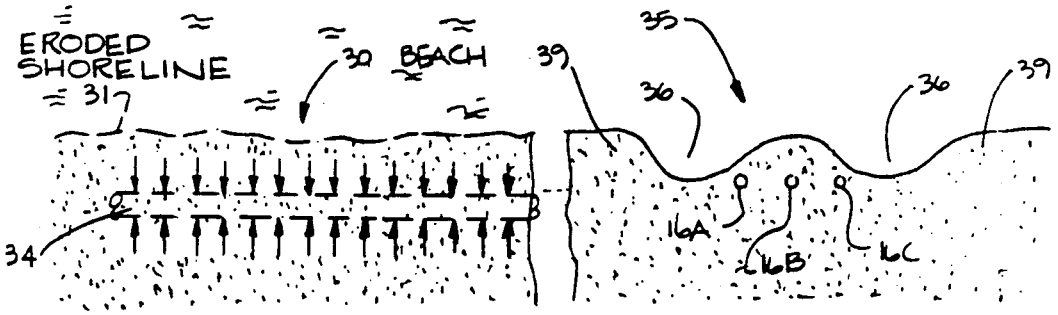
FIG. 10 is a schematic elevation of the same eroded beach and shoaled navigation channel, taken in FIG. 9 along X-X onshore at the left and offshore at the right.

FIG. 10 again shows BEACH 30 at the left and CHANNEL 35 at the right, but this time in schematic sectional elevation. The beach section is taken at an onshore location at X-X as already noted. Horizontal foraminous pipe 34 is shown just underneath the surface. Arrows pointing into the pipe indicate extraction of water from the beach soil, which is saturated or nearly so most (if not all) of the time. The channel section shows SHOAL 37 as a hump flanked by pair of shallow dips 36 between banks 39.

Figure 11:
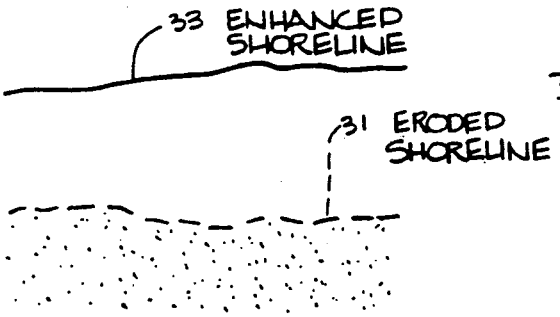
FIG. 11 is a plan of the beach of the left portions of FIGS. 9 and 10 after enhancement by sandy subsoil received from the previously shoaled channel.

FIG. 11 shows BEACH 30 in plan with ENHANCED SHORELINE 33 in place of former ERODED SHORELINE 31 (broken lines). It should be understood that, at sea and on most bays and many large lakes, wave action carries onto beaches temporarily supported subsoil and leaves some on the beach when washing back offshore, also usually removing some from the beach at the same time. At times the amount deposited exceeds the amount removed, and at other times (as in storms) more is removed than is deposited. Judicious operation of a dewatering pipe as illustrated can tip the balance in favor of the beach, and over time can enhance beaches that otherwise soon lose whatever sand other human efforts deposit thereon. As already noted, favorable drift may assist in redepositing there sand removed from elsewhere.

Figure 12:
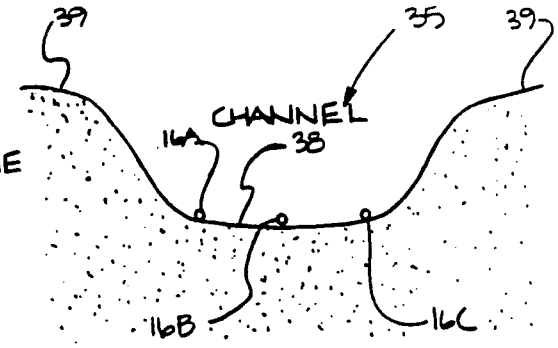
FIG. 12 is a sectional elevation of the channel of the right portions of FIGS. 9 and 10 after being de-shoaled by fluidization.

FIG. 12 shows CHANNEL 35 in section with fluidization pipes in place, lying about flush with a substantially flat bottom. U-shaped contour 38 defines substantially the whole width between the banks, as the former shoal has been removed. It will be understood that fluidization at widely spaced intervals usually can preclude shoaling, and that eduction pipes are unnecessary when longshore drift is favorable, though they aid in collection for alternative transport.

An eduction pipe may be supported on a barge, from a crane, or by a platform rigged onshore or offshore. It may be movable, as along a centerline between flanking fluidization pipes. A pump may be provided at or near the intake end and may be supplemented by one or more additional pumps along its length.

Fluidization pipes do not have to be laid parallel as shown and with both the supply pipe and the water-jetting tubes mutually parallel, but such arrangements are recommended. More complex patterns bring their own disadvantages in installation and operation, though any way of providing the desired array, whether linear or areal, can be effective if operated with care and at appropriate intervals with appropriate durations. Every site differs from every other site, so experience, intelligence, and luck all can contribute to success.

Selection of appropriate supply piping, valving, and jet tubes is well within the skill of persons familiar with hydraulic arts. A uniformly foraminous plastic tube is suitable for a dewatering pipe, but for a fluidization pipe it is preferable to concentrate openings principally downward, secondarily sideward, and to avoid openings upward for conservation and effectiveness of effort.

Placement and retention of fluidization pipes and of dewatering pipes may employ fluidization of the subsoil to embed them properly. Alternatively, they may be ditched into place. Normally they can be left in place for years without necessity for maintenance or repair but should be operated frequently if only for short times to keep them free of potentially clogging marine growth or other deposits.

Programming of sequential fluidization has been considered at some length herein, but as in most endeavors there is no substitute for experience. A skilled human operator may become able to "play" the keyboard to produce the most effective peristaltic action, with the benefit of a graphical read-out or pictorial representation of the sensed underwater flow or pressure of the fluidized subsoil.

Selection of sensors for flow and/or pressure is within the skill of persons familiar with hydraulic instrumentation. Strain gages may be mounted above the supply pipes, and their readings be fed to the central control unit for analysis or interpretation. If desired, the same or suitable instruments may be deployed in an array covering the area of interest, which may be more extensive than the jet injection arrays, and be supported from floats or the like.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Method of inducing lateral flow of underwater noncohesive subsoil overhead in any preselected direction, comprising preselecting an overhead direction, injecting water into the subsoil sequentially at laterally spaced multiple locations to fluidize increments of subsoil in succession, the direction of such succession being substantially opposite to the overhead flow direction as viewed in plan.

2. Method according to claim 1, including injecting the water repetitively at respective locations.

3. Method according to claim 1, including injecting the water at diverse times at respective locations.

4. Method according to claim 1, including injecting the water for diverse durations at respective locations.

5. Method according to claim 1, including injecting the water according to a preselected pattern in both time and space.

6. Clearing an otherwise navigable channel of a shoal made up of non-cohesive subsoil according to the method of claim 1, wherein natural drift of water overlying the shoal location is insufficient to carry away the fluidized shoal subsoil, and including the step of transporting the fluidized shoal subsoil laterally from the channel to a location outside it by pumping such fluidized subsoil away from a collection locus selected to receive such lateral overhead flow within the channel.

7. Clearing an otherwise navigable channel of a shoal made up of non-cohesive subsoil according to the method of claim 1, wherein natural drift of water overlying the shoal location is insufficient to carry away the fluidized shoal subsoil, and including the step of injecting the water progressively at respective locations and times, thereby inducing lateral overhead currents across the channel to outside it and so transporting some of the fluidized subsoil from the channel.

8. Method of clearing an otherwise navigable channel of a shoal made up of non-cohesive subsoil wherein natural drift of water overlying the shoal location is insufficient to carry away the fluidized shoal subsoil, including the steps of:

injecting water into the subsoil at laterally spaced multiple locations to fluidize spaced increments of subsoil, progressively at respective locations and times and thereby inducing lateral overhead currents across the channel to outside it and so transporting some of the fluidized subsoil from the channel, monitoring water conditions in the vicinity of the shoal and adjusting the locations and times of injecting water into the subsoil in such vicinity so as to control lateral transporting of the fluidized shoal subsoil from the channel.

9. Method of peristaltically fluidizing underwater non-cohesive subsoil for lateral overhead transport from an undesired location to a desired location, comprising the steps of selecting a multiplicity of laterally spaced locations for sequential injection of water throughout a subsoil region to be fluidized, providing foraminous water-jetting means in an areal array made up of such repeatedly and sequential injection locations, and sequentially jetting water from the water-jetting means downward into the subsoil.

10. Fluidization method according to claim 9, including inducing overhead lateral currents toward a given locus in the areal array by sequential injection of water at selected times and locations.

11. Fluidization method according to claim 10, including providing an eduction pipe with an intake at such given locus, and removing fluidized subsoil through such eduction pipe.

12. Fluidization method according to claim 9, including inducing overhead lateral currents toward a given locus outside the areal array by sequential injection of water at selected times and locations.

13. Fluidization method according to claim 12, including depositing fluidized subsoil on a beach at such outside locus.

14. Peristaltic fluidization apparatus, comprising water-jetted means arranged in an areal array of injection locations throughout an underwater region of non-cohesive subsoil, piping means connecting to and supplying the water-jetting means with fluidizing water, individual valve means between the piping means and each of the water-jetting means, and valve control means interconnected to and effective to actuate the individual valve means repeatedly sequentially in a given plan direction relative to the array to effect oppositely directed overhead lateral flow of fluidized subsoil.

15. Fluidization apparatus according to claim 14, including strain-gauge pressure-sensing means at sensing loci in the water overlying the areal array and interconnected to the valve control means.

16. Fluidization apparatus according to claim 15, including means programming the valve control means in response to the pressure-sensing means to induce peristaltic currents in the water.

* * * * *